US006915839B2

(12) United States Patent
Poloni et al.

(10) Patent No.: US 6,915,839 B2
(45) Date of Patent: Jul. 12, 2005

(54) METHOD TO SHEAR A STRIP DURING THE CASTING STEP

(75) Inventors: Alfredo Poloni, Fogliano di Redipuglia (IT); Nuredin Kapaj, Udine (IT)

(73) Assignee: Danieli & C. Officine Meccaniche SpA, Buttrio (IT)

( * ) Notice: Subject to any disclaimer, the term of this patent is extended or adjusted under 35 U.S.C. 154(b) by 105 days.

(21) Appl. No.: 10/472,515

(22) PCT Filed: Mar. 25, 2002

(86) PCT No.: PCT/IB02/00888

§ 371 (c)(1),
(2), (4) Date: Sep. 24, 2003

(87) PCT Pub. No.: WO02/076655

PCT Pub. Date: Oct. 3, 2002

(65) Prior Publication Data

US 2004/0104006 A1 Jun. 3, 2004

(30) Foreign Application Priority Data

Mar. 26, 2001 (IT) ..... UD2001A0058

(51) Int. Cl.[7] ..... B22D 11/08
(52) U.S. Cl. ..... 164/483; 164/428

(58) Field of Search ..... 164/480, 483, 164/428

(56) References Cited

U.S. PATENT DOCUMENTS 5,287,912 A 2/1994 Folder et al.
5,511,606 A * 4/1996 Streubel ..... 164/476
5,690,163 A 11/1997 Leadbeatter et al.
6,524,408 B1 * 2/2003 Schmitz et al. ..... 148/541

FOREIGN PATENT DOCUMENTS

JP 55128354 10/1980

* cited by examiner

*Primary Examiner*—Jonathan Johnson
*Assistant Examiner*—Len Tran
(74) *Attorney, Agent, or Firm*—Stevens, Davis, Miller & Mosher, LLP

(57) ABSTRACT

Method to shear a strip during the casting step, wherein the casting speed is increased, with respect to a speed of a stationary regime, maintaining the thickness of said cast strip constant to the value corresponding to the speed of a stationary regime, in order to determine the formation of a quid core which determines the re-melting of the adjacent skin and the breakage of the strip due to the weight of the part of the strip located under the liquid core.

11 Claims, 3 Drawing Sheets

METHOD TO SHEAR A STRIP DURING THE CASTING STEP

FIELD OF THE INVENTION

The invention concerns a method to shear a metal strip during the production thereof by means of continuous casting from the liquid metal.

The invention can be used in particular to remove a leading end segment of a desired length of a strip emerging from a continuous casting machine with two rollers, or, at the end of casting, to eliminate the terminal segment cast during the final transitory period.

The invention can also be used in any step whatsoever of the casting, for example in emergency conditions to interrupt cleanly the strip cast before discharging the liquid metal contained in the casting machine, or to separate the production of two strips of different thickness, or again when the machine is operating in stationary conditions and it is desired to separate segments of strip for production reasons.

To be more exact, the invention concerns a shearing method by means of which it is possible to separate a desired segment of strip during any step of the casting whatsoever, without using mechanical devices or other auxiliary assemblies provided specifically for such operation.

The invention is applied particularly but not exclusively in continuous casting machines of the roller type (strip caster).

BACKGROUND OF THE INVENTION

It is known that the initial segment of strip, produced in non-stationary conditions, has an irregular conformation which could make it difficult for the strip to enter the pinch-roll or possible rolling stands, which usually have a limited aperture.

This irregular conformation, moreover, has a quality which is unacceptable from the production point of view.

The final segment of the cast strip is also produced in non-stationary conditions and therefore has an unacceptable quality.

The solution to this problem is to remove a leading or trailing end segment, of the desired length, by means of shearing equipment located immediately downstream of the continuous casting machine and upstream of the first rolling stand.

However, this solution, especially for steel, has technical and operating problems which often make it impossible to use. In fact, the environment downstream of the continuous casting machine is very critical, particularly because the strip, downstream of the casting rollers, is made to pass inside a closed environment with an inert atmosphere and kept at high temperature, in the case of steel around 700÷1000° C., to prevent surface oxidation of the strip. This entails considerable difficulties in installing and controlling shearing equipment such as shears or similar, and also in their functioning.

The need to interrupt a strip cleanly while it is being cast can occur even in an intermediate step of the casting, for example in emergency situations, or to separate the production of strips of different thickness, or again, for production reasons, to divide the strip into several segments during a casting in stationary conditions.

Documents U.S. Pat. No. 5,690,163 and U.S. Pat. No. 5,287,912 disclose a method to shear a strip during the casting step by means of increasing, for a brief period, the distance between the casting rollers, keeping the casting speed constant, said increase being then followed by a restoration of the distance adopted in the stationary regime. This increase in thickness of the strip, maintaining the same casting speed, and hence maintaining the same time of contact between the strip and the cooled rollers, determines the formation of an inclusion of liquid metal between two thicknesses of solidified skin. This inclusion causes, downstream of the kissing point, the skins to melt again and the strip to break due to its own weight.

The present Applicant has devised and embodied this invention to overcome the shortcomings of the state of the art and to obtain other advantages as shown hereafter.

SUMMARY OF THE INVENTION

The invention is set forth and characterized in the main claim, while the dependent claims describe other innovative characteristics of the main embodiment.

The purpose of the invention is to achieve a method to shear strip during the casting step which will allow to avoid using equipment provided specially for this purpose.

To be more exact, the invention proposes to obtain the separation, in a substantially natural manner, of a segment of a desired length of strip, or the separation at a desired point of two segments of strip cast in stationary manner, exploiting the effect of the variation in the solidification of the liquid metal between the rollers, deriving from a variation in the casting speed and hence in the time of contact between the strip and the cooled surface of the rollers, keeping the thickness of the cast strip constant to the value corresponding to the speed used in stationary regime.

Modifying the casting speed, with the same overall thickness of the cast strip as defined by the distance between the rollers, determines a variation in the conditions of heat exchange, and hence of solidification, of the strip due to the corresponding variation in the time of contact between cooled surfaces of the rollers and liquid metal.

The thickness of solid skin which forms during the passage of the liquid metal on the cooled surfaces of the rollers is inversely proportional to the casting speed raised to an exponent, which for steel is less than 1. An increase in the casting speed therefore determines a reduction in the solidified thickness of the skins, just as a reduction in the casting speed determines an increase in the solidified thickness of the skins, given the same cooling conditions of the rollers.

In the continuous casting of strip with two rollers, it is preferable if solidification is complete at the point of minimum distance between the rollers, the so-called "kissing point".

With the method according to the invention, the end-of-solidification point is displaced below the kissing point, advantageously increasing for a brief interval of time the casting speed with respect to a pre-set normal casting speed, and keeping the distance between the rollers constant to the value corresponding to this speed. After this time interval, in a first embodiment of the invention, the casting speed is returned substantially to the starting value, possibly after a brief time of settling around said value.

According to a first variant, the increase in speed is preceded by a deceleration step, so that this increased speed does not correspond to an excessive value of the rotation speed of the rollers and such as to entail too high an increase in the power of the motor which makes them rotate.

This deceleration step is advantageously accompanied by a corresponding increase in the thickness of the cast strip, obtained by modifying the distance between the casting rollers, in order to keep the conditions of heat exchange constant, and hence of solidification of the skins of the strip; this allows to prevent, in this case, too precocious a solidification of the strip caused by the reduction in the speed of passage between the rollers.

The portion of liquid metal, or inclusion, included between the kissing point and the end-of-solidification point which is obtained with the brief increase in the casting speed, remains incorporated inside the strip when the casting speed is returned to the original value.

This liquid portion affects a longitudinal segment of the strip where, downstream of the rollers, it causes the solidified skin to be heated, and takes it to a temperature near the re-melting point.

This longitudinal segment of strip therefore has very limited mechanical properties, so that it is not able to support the weight of the part of the strip located underneath. This causes the breakage of the strip in correspondence with said segment and hence a segment of a desired length is naturally and cleanly removed.

The shearing position can be set at will by adjusting the moment at which the casting speed is increased.

The duration of the interval during which the casting is performed at an increased speed is chosen so as to ensure the safety of the breakage of the strip; it depends on a plurality of parameters, including the thickness of the strip, the cooling parameters, the type of material, the length and hence the weight of the segment to be removed.

For steel, in the cases of most general use, an interval of about 0–200 milliseconds at increased speed, associated with an acceleration time comprised between about 50 and about 600 milliseconds, is sufficient to create inside the strip a sufficient liquid zone which will allow the natural breakage of the strip due to the weight of its leading end segment alone.

In another embodiment of the invention, after the increase in speed which creates the inclusion of liquid metal downstream of the kissing point, the casting speed is kept at said increased value. In this case, once the inclusion has been formed with a constant thickness of strip, the overall thickness of the strip is reduced, by reducing the distance between the rollers, keeping the conditions of heat exchange, and hence of solidification of the skins of the strip, constant and similar to the stationary regime.

BRIEF DESCRIPTION OF THE DRAWINGS

These characteristics and advantages of the invention will become apparent from the following description of the preferential embodiment of the invention, given as a non-restrictive example with reference to the attached drawings wherein.

DETAILED DESCRIPTION OF SOME PREFERENTIAL EMBODIMENTS

Figure 1:
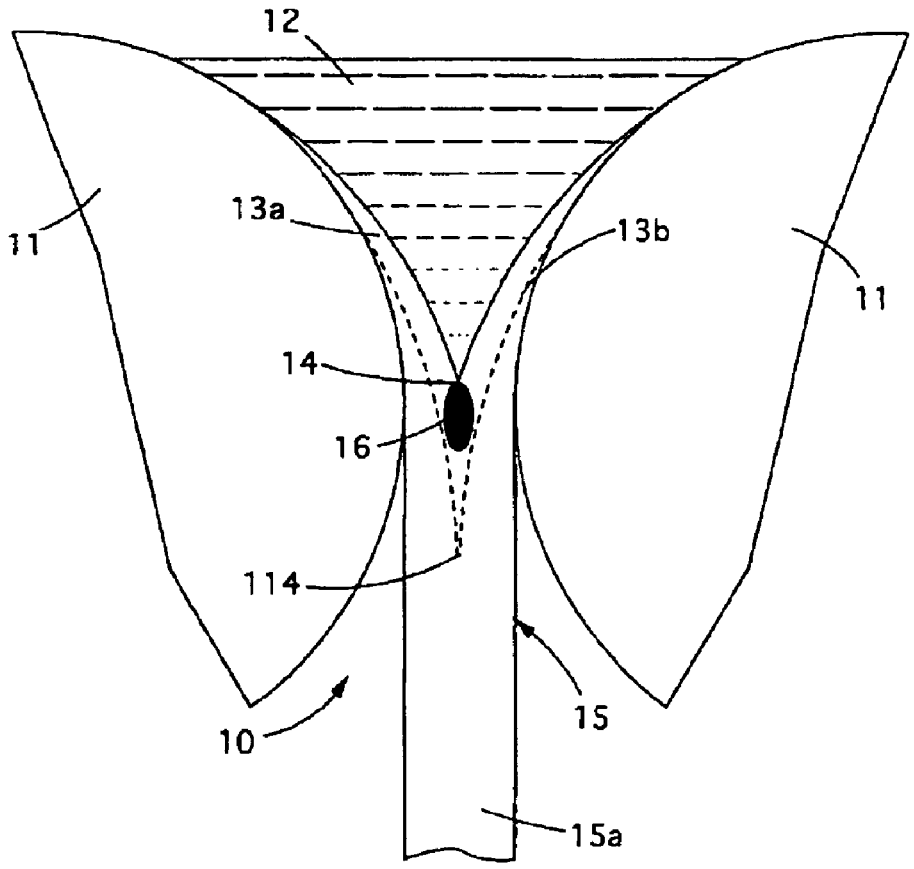
FIG. 1 is a schematic view of a casting machine with rollers wherein the method according to the invention is used.

With reference to the attached drawings, and particularly to FIG. 1, number 10 denotes generally and schematically a continuous casting machine with two rollers 11, wherein molten metal 12 is discharged by suitable means (not shown here) and cast through a gap with an adjustable amplitude defined by the reciprocally facing surfaces of said rollers 11.

Downstream of the rollers 11 there are usual, and not shown here, guide and extraction systems, normally with rollers, associated with cooling means.

The rollers 11, in known manner, are cooled at least on the surface and the contact between the molten metal 12 and these cooled surfaces causes the formation of two at least partly solidified half-skins 13*a*, 13*b*, which preferentially join in correspondence with the kissing point 14, corresponding to the position of minimum distance between the two rollers 11.

At outlet from the rollers 11, thanks also to the cooling systems located downstream, a solidified strip 15 is obtained which is sent for rolling.

In order to remove a segment, for example a leading end segment 15*a*, of the strip 15, or a trailing end segment, or also to separate the strip 15 at a desired intermediate point, the invention provides to increase the casting and removal speed, starting from a time $t_0$, for example from an initial nominal value $v_1$, which for steel can have a value, for example, of about 40 m/min (as in the graph in FIG. 2*a*) to a nominal value $v_0$ having a value for steel, for example, of about 52 m/min, reached at time $t_1$. Time $t_0$ at which the increase in speed is started depends, for example, on the length of the leading end segment 15*a*, or of the trailing end segment, which has to be removed, or on the position at which it is desired to separate two segments of strip 15.

The time needed to obtain said increase in speed, equal to $t_1-t_0$, for steel is normally comprised between 50 and 600 ms, for example about 300 ms.

The increased speed is maintained until a time $t_2$, for an interval $(t_2 - t_1)$ advantageously very brief, comprised between about 0 and, for steel, about 200 milliseconds. In the case shown in the graph, this interval is equal to 100 milliseconds.

Then this speed is reduced until, at time $t_3$, it again has the value $v_1$ of the stationary regime.

With this increase in speed from $v_1$ to $v_0$, and keeping the thickness of the strip constant and equal to $s_1$, for example in the case of steel about 2.4 mm, the end-of-solidification point 114 is displaced below said kissing point 14, for a segment determined by the duration of the acceleration and deceleration ramps, by the value of maximum speed reached and by the time $t_2-t_1$ for which said increased speed is maintained substantially constant.

This is because for the whole interval $t_3-t_0$, comprising the acceleration and deceleration ramps, the time of contact is reduced between the cooled surfaces of the rollers 11 and the corresponding half-skins 13*a*, 13*b* of the strip 15, with respect to the value which we would have at stationary speed, so that the solidified thickness of said half-skins 13*a*, 13*b* is reduced correspondingly.

The portion of liquid metal 16 comprised between the kissing point 14 and the end-of-solidification point 114 which is obtained with this brief increase in the casting speed remains incorporated inside the strip 15 when the casting speed is returned to the original value.

Figure 2A:
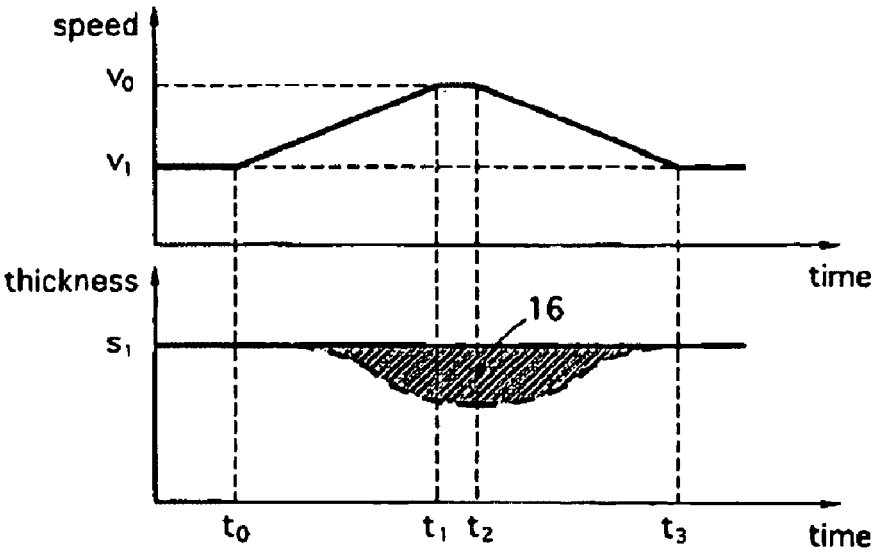
FIGS. 2*a*–2*d* show graphs concerning the development of the casting speed and the relative thickness of the strip in some possible applications.

The presence of the liquid inclusion 16 is visible in the lower graph in FIG. 2*a*, wherein the line of dashes represents the development of the value of the overall solid thickness of the strip 15, obtained by adding together the thickness of the two half-skins 13*a*, 13*b*, while the continuous line represents the overall thickness of the strip 15.

This liquid portion 16 affects a longitudinal segment of the strip 15 where, downstream of the rollers 11, it causes the solidified skin to be heated, taking it to a temperature near the re-melting point.

Figure 3:
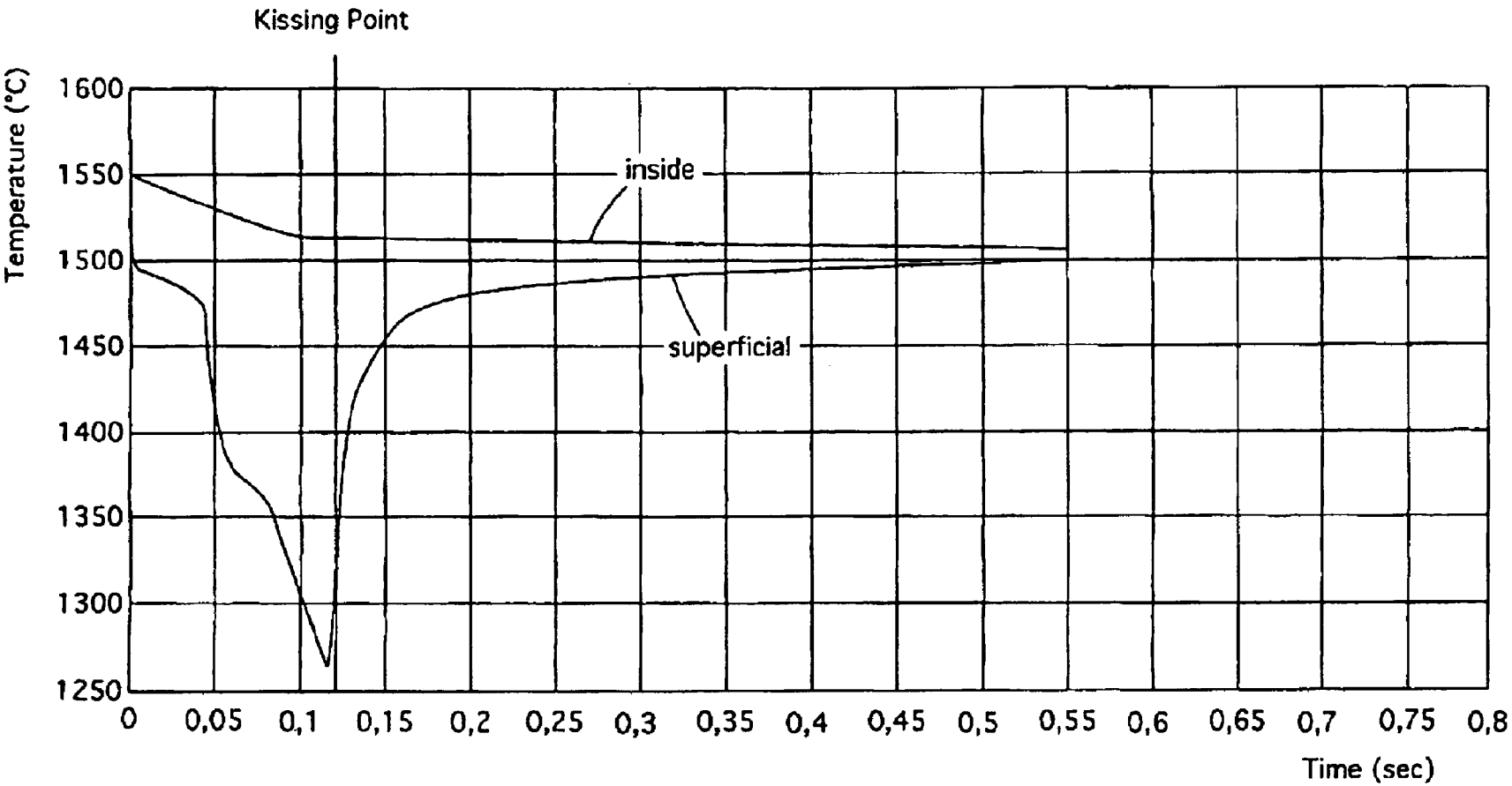
FIG. 3 is a graph of the development over time of the internal and surface temperature of a segment of strip, in correspondence of the inclusion, cast using the method according to the invention.

At this point please see the graph in FIG. 3, which shows how the surface temperature of a segment of steel strip 15, cast in correspondence with the inclusion, rises suddenly at outlet from the rollers 11 due to the residual heat transmitted from the liquid core 16 which is created due to the increase in the speed transmitted to the strip 15. This surface temperature almost reaches the value of the internal temperature and hence approaches melting temperature, causing the solid skin formed before outlet from the rollers 11 to return to an almost liquid condition.

In this condition, there is a drastic reduction in the mechanical properties of the solid portion of the strip 15 around the liquid core 16, so that the weight caused, in this case, by the leading end segment 15*a* causes the breakage of the strip 15 in correspondence with the liquid core 16 and hence said leading end segment 15*a* is naturally separated.

When the increased casting speed interval is finished, the speed is reduced to return to the starting speed, in this case around 40 m/min, in the case of steel.

Figure 2B:
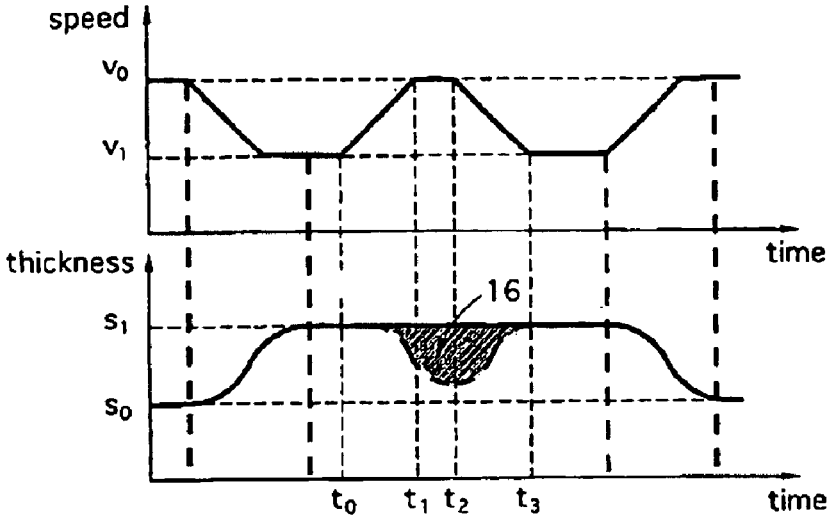

According to the variant shown in FIG. 2*b*, the casting speed is first taken to a value $v_1$ less than that of the stationary regime $v_0$, and then increased again, for a brief period, to the value $v_0$ in order to create the conditions which determine the formation of a liquid inclusion 16 as seen before. This deceleration step is performed so that the value of increased speed $v_0$ is not too high and does not lead to an excessive increase in the power of the motors of the casting rollers.

In this case, since the thickness of the strip 15 which solidifies is inversely proportional to the casting speed raised to an exponent, which in the case of steel is less than 1, a correlated increase in the thickness of the cast strip 15 is associated with the reduction in speed, for example for steel from a value $s_0$ of about 1.8 mm to a value $s_1$ of about 2.4 mm.

This increase in thickness, obtained by modifying the distance between the rollers 11, is necessary to maintain the cooling conditions of the strip 15 substantially constant so that, until time $t_0$ when the speed is increased, the conditions of solidification of the half-skins 13*a*, 13*b* remain substantially corresponding to the stationary case.

In corresponding manner, if, after the inclusion 16 has been formed, we want to return the casting speed to a higher value $v_0$, without this entailing the formation of further inclusions 16, it is necessary, as can be seen in the right part of the graph in FIG. 2*b*, to reduce the thickness of the cast strip 15 from a value $s_1$ to a value $s_0$, also modifying, in this case, the gap between the rollers 11.

The necessary duration of the interval $(t_3-t_0)$, comprising the ramps and the time at increased speed, is chosen on each occasion to obtain the minimum conditions which ensure that a sufficient liquid core 16 is formed so as to cause the breakage of the strip 15 due to the weight of the leading end segment 15*a*, the trailing end segment or the intermediate segment underneath.

Figure 2C:
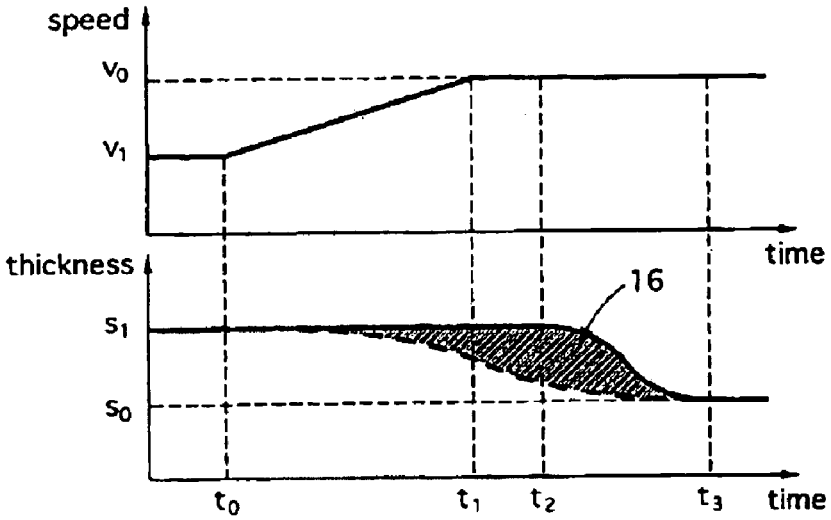
Figure 2D:
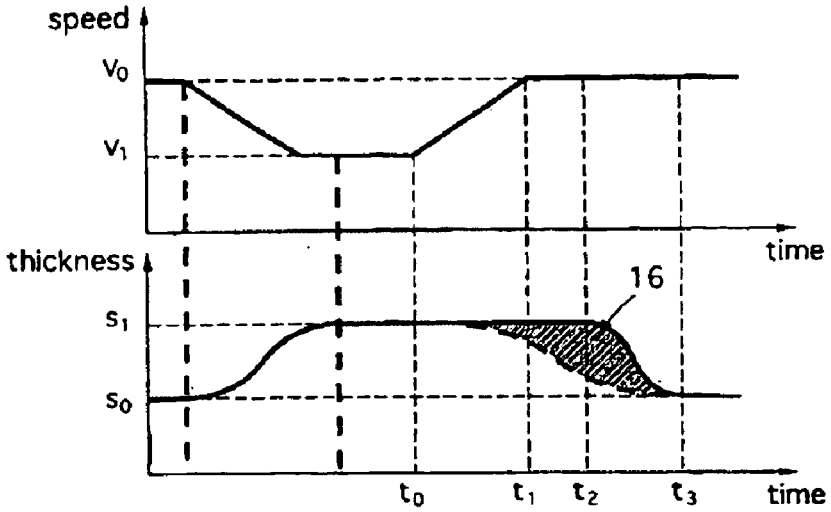

According to the embodiment shown in the graphs in FIGS. 2*c* and 2*d*, the shearing occurs simply due to the increase in the casting speed, from a value $v_1$ to a value $v_0$.

This increase determines the formation of an inclusion 16 of liquid metal substantially in the same manner as seen before. However, after having formed said liquid inclusion 16, the casting speed is not returned to the original value, but maintained at the increased value $v_0$ (FIG. 2*c*). This maintained increased value is accompanied by a corresponding reduction in the thickness of the strip 15, from a value $s_1$ to a value $s_0$, so that downstream of said inclusion 16 cooling conditions, and hence solidification conditions, are substantially maintained, corresponding substantially to the situation of a stationary regime. This enables to obtain the shearing when the solid skin around the inclusion 16 melts again and the weight of the segment of strip 15*a* causes the strip 15 to break in correspondence with said inclusion 16.

In the application shown in FIG. 2*d*, in a manner substantially identical to what is shown in FIG. 2*b*, the method provides a first deceleration step, accompanied by a correlated increase in the thickness of the strip 15, in order to determine a start-up speed low enough to keep the increased speed $v_0$ at a value which is not too high.

Deceleration is then followed by an acceleration at a constant thickness, which determines the formation of the inclusion 16 of liquid metal. Then the speed is maintained constant at said increased value, but the thickness is reduced in correlated manner in order to maintain the cooling and solidification conditions corresponding to the situation of a stationary regime.

As said above, it is obvious that this method can also be applied substantially with the same principles and the same methods to shear the strip 15 at any section other than the leading end segment, for example to remove a trailing end segment, or to crop the strip 15 at any intermediate section.

Modifications and/or additions can be made to the method as described heretofore without departing from the spirit and scope thereof.

What is claimed is:

1. Method to shear a strip during the casting step as it emerges from a machine for the continuous casting of liquid metal comprising at least a pair of casting rollers, said machine comprising at least cooling means able to achieve the solidification of said strip, characterized in that it provides to increase the casting speed with respect to a speed of a substantially stationary regime, maintaining the value of speed increased for an interval (t2–t1), said increase in speed being performed keeping the thickness of said cast strip substantially constant to the value corresponding to the speed of a stationary regime, in order to determine a consequent formation of a liquid core inside said strip at least in its segment passing at increased speed through said cooling means, said liquid core causing the at least partial re-melting of the skin adjacent thereto and the breakage of the strip due to the weight of the part of the strip located under said liquid core.

2. Method as in claim 1, wherein said interval at increased speed is finished, the casting speed is returned to a value substantially equal to the stationary regime speed.

3. Method as in claim 2, wherein after returning the speed to a value substantially equal to that of a stationary regime, and after obtaining the shearing of the strip, the casting speed is again increased and, in correlated manner, the thickness of the strip is reduced in order to obtain conditions of heat exchange and solidification of the strip substantially corresponding to those of a stationary regime.

4. Method as in claim 1, wherein having finished said interval at increased speed, the casting speed is maintained at said increased value, and a correlated reduction is performed in the thickness of the cast strip in order to obtain conditions of heat exchange and solidification of the strip substantially corresponding to those of a stationary regime.

5. Method as in claim 1, wherein before said increase in speed, the casting speed is temporarily reduced and that, in correlation with said reduction in speed, the thickness of said strip is increased in order to obtain conditions of heat exchange and solidification of the strip substantially corresponding to those of a stationary regime, the function of said reduction in speed being to limit the power required from the motors associated with said casting rollers.

6. Method as in claim 1, wherein the duration of said interval (t2–t1) is at least a function of the thickness of the strip and of the type of metal cast.

7. Method as in claim 1, wherein the duration of said interval (t2–t1) in the case of steel, is comprised between about 0 and 200 milliseconds.

8. Method as in claim 1, wherein the time required to take the casting speed to an increased value, in the case of steel, is comprised between about 50 and about 600 milliseconds.

9. Method as in claim 1, wherein it is used to remove a leading end segment of a strip during the casting step.

10. Method as in claim 1, wherein it is used to remove a trailing end segment of the strip.

11. Method as in claim 1, wherein it is used to crop the strip at an intermediate section thereof, in emergency situations or to separate two strips of different thickness or to divide two segments of strip for production reasons.

* * * * *